United States Patent [19]

Gash

[11] Patent Number: 4,637,465

[45] Date of Patent: Jan. 20, 1987

[54] REMOVAL OF PHENOLS IN GROUNDWATER AFTER UNDERGROUND GASIFICATION OF COAL

[75] Inventor: Bruce W. Gash, Tulsa, Okla.

[73] Assignee: Standard Oil Company, Chicago, Ill.

[21] Appl. No.: 699,773

[22] Filed: Feb. 8, 1985

[51] Int. Cl.[4] ..... E21B 43/243; E21B 43/34

[52] U.S. Cl. ..... 166/261; 166/266; 166/267; 166/271; 210/747; 299/12

[58] Field of Search ..... 166/247, 251, 261, 266, 166/267, 271; 299/2, 12; 48/DIG. 6; 208/8 R, 263; 210/747

[56] References Cited

U.S. PATENT DOCUMENTS

| | | | |
|---|---|---|---|
| 1,913,395 | 6/1933 | Karrick | 48/DIG. 6 X |
| 3,673,070 | 6/1972 | Wiley | 208/263 X |
| 3,823,776 | 7/1974 | Holmes | 166/261 |
| 4,016,075 | 4/1977 | Wilkins | 210/747 X |
| 4,032,193 | 6/1977 | Drinkard et al. | 166/261 X |
| 4,114,688 | 9/1978 | Terry | 166/266 X |
| 4,162,902 | 7/1979 | Wiesner et al. | 208/263 X |
| 4,256,568 | 3/1981 | Schlosberg et al. | 208/263 |
| 4,277,327 | 7/1981 | Schlosberg et al. | 208/8 R X |

*Primary Examiner*—George A. Suchfield

*Attorney, Agent, or Firm*—Timothy H. Briggs; Robert R. Cochran

[57] ABSTRACT

Disclosed is a method for removing phenols from an underground gasification zone by injecting an alkaline material to convert at least a portion of the phenols to the corresponding salt and producing the solution of said salt. Thereafter, the salt can be converted to the free phenol or merely evaporated to dryness. In both of these cases, the phenol or salt can be incinerated.

8 Claims, No Drawings

REMOVAL OF PHENOLS IN GROUNDWATER AFTER UNDERGROUND GASIFICATION OF COAL

BACKGROUND OF THE INVENTION

This invention relates to the removal of phenols, unavoidably produced as byproducts in the underground gasification of coal, by treatment of the groundwater after gasification.

Somewhat related to this invention is the treatment of hydrocarbon streams for the removal of phenol therefrom as shown in Schlosberg, et al., U.S. Pat. No. 4,256,568 (1981). In this patent, hydrocarbon streams are treated with multivalent metal compositions (hydroxides) to convert phenols to the corresponding phenates. In the Specification of this patent, a distinction is made for this treatment between the multivalent hydroxides and monovalent hydroxides such as sodium or potassium hydroxide. The patent shows the formation of a salt by the reaction of the phenol with sodium hydroxide.

The present invention is distinguished from that of the patent mentioned since the treatment is carried out in the formation. Further, systems are described for the destruction of the undesirable phenols.

During the underground gasification of coal phenols are produced as stated above. These phenols are environmentally hazardous because they are toxic and are soluble in groundwater. Years after gasification of a coal seam, phenol concentrations in the groundwater near the gasification sites have been unacceptably high.

An object of this invention is to provide a method for the removal of phenols from underground formations after coal gasification. Other objects and advantages of the invention will be apparent to those skilled in the art upon reading this disclosure.

The term "phenols", is used herein to include the various hydroxybenzenes, including phenol itself, catechol, resorcinol, hydroquinone, pyrogallol, hydroxyquinol, and phloroglucinol. The present invention will also serve to remove any thiophenols present, but these are present in far lesser quantities than the phenols themselves.

SUMMARY OF THE INVENTION

Broadly, this invention relates to a method for removing phenols from an underground gasification zone after coal conversion is terminated provided with at least one injection well and at least one production well comprising injecting into said zone an aqueous alkali metal or ammonium hydroxide solution in an amount sufficient to convert at least a portion of the phenols present in said zone to the corresponding salt, said salt being more water soluble than the phenol, and producing an aqueous solution of said salt.

A variety of systems can be used, but fundamentally, they involve injecting the alkali metal or ammonium hydroxide solution at the periphery and producing the salt at one or more locations in the zone. Alternatively, the alkaline solution can be injected into the zone and produced at the periphery thereof.

For disposal of the phenols, two systems are used. In one, a mineral acid is added thereby converting the produced salt to the free phenol which precipitates. An alternative is merely to evaporate the aqueous salt solution to dryness. In both cases, the phenol or salt can be subsequently incinerated.

PREFERRED EMBODIMENTS

As is known, phenols are weakly acidic organic compounds which are extremely soluble in dilute solutions of an alkali metal or ammonium hydroxide. Hydroxides normally used in the practice of this invention are sodium hydroxide, potassium hydroxide, or ammonium hydroxide. The other alkali metal hydroxides could, of course be used, but these would not be economically feasible. The treating solution can be widely varied, but in normal operation, the concentration should be relatively dilute and preferably in the range of 0.001 to 5 N. This injected solution will dissolve the phenols produced in the gasification process. For the conversion of the produced salt to the free phenol for recovery thereof, mineral acids are used. Examples include hydrochloric acid, sulfuric acid, and nitric acid.

EXAMPLE

The following example illustrates a specific embodiment of this invention, but it should not be considered unduly limiting. In one run for underground coal conversion work, a seam 100 feet by 127 feet by 30 feet was burned, this amounting to $1.06\times10^9$ cubic meters or $1.06\times10^7$ liters. The aqueous solution was saturated with phenol containing 1 gram thereof per 15 ml of water or 67 grams per liter. Phenol, with a molecular weight of 94.1 grams would then produce a 0.71 N solution. One normal sodium hydroxide was used in the amount of $0.75\times10^7$ liters to produce the sodium salt. This amounted to a liquid stream injected of $2\times10^6$ gallons. Each liter of sodium hydroxide contained 40 grams so that the total injected was $3\times10^5$ s kilograms of sodium hydroxide corresponding to $6.6\times10^5$ s pounds of sodium hydroxide.

The total amount of sodium hydroxide injected will depend upon the composition of the water before and after the gasification step. The requirements at present require that the aquifer be treated after gasification to return the groundwater composition to the original water composition, this being referred to as the baseline. Thus, it will be necessary to treat until the baseline composition is reached.

Although the present invention has been described in conjunction with the preferred embodiment, it is to be understood that modifications and variations may be resorted to without departing from the spirit and scope of the invention, as those skilled in the art will readily understand.

I claim:

1. A method for removing phenols from an underground gasification zone after coal conversion is terminated, provided with at least one injection well and at least one production well comprising injecting into said zone through at least one well extending into said zone an aqueous alkali metal or ammonium hydroxide solution in an amount sufficient to convert at least a portion of the phenols present in said zone to the corresponding salt, said salt being more water soluble than the phenol, and producing from at least one well extending into said zone an aqueous solution of said salt.

2. The process of claim 1 wherein said alkali metal or ammonium hydroxide solution is injected at the periphery of said zone through at least one well extending into said zone and produced at one or more locations in said zone from at least one well extending into said zone.

3. The process of claim 1 wherein said alkali metal or ammonium hydroxide solution is injected into said zone through at least one well extending into said zone and produced at the periphery of said zone from at least one well extending into said zone.

4. The process of claim 1 wherein the phenols are removed from the produced solution by addition of a mineral acid thereby converting the produced salt to the free phenol which precipitates.

5. The process of claim 4 wherein the phenol is incinerated.

6. The process of claim 4 wherein the solution is evaporated to dryness after precipitation of the free phenol.

7. The process of claim 1 wherein the produced aqueous salt solution is evaporated to dryness.

8. The process of claim 7 wherein the salt is incinerated.

* * * * *